United States Patent [19]

Robinson

[11] Patent Number: 4,895,282

[45] Date of Patent: Jan. 23, 1990

[54] DISPENSING CLOSURE WITH PULL TAB FOR ENLARGING ORIFICE

[75] Inventor: Gerald R. Robinson, Perrysburg, Ohio

[73] Assignee: Owens-Illinois Closure Inc., Toledo, Ohio

[21] Appl. No.: 226,494

[22] Filed: Aug. 1, 1988

[51] Int. Cl.[4] ..... B67D 3/00

[52] U.S. Cl. ..... 222/482; 222/541; 222/546; 215/216

[58] Field of Search ..... 222/478, 480, 481, 482, 222/484–486, 541, 546, 543, 568, 153; 215/209, 216, 225, 230, 363

[56] References Cited

U.S. PATENT DOCUMENTS

| | | | |
|---|---|---|---|
| 2,055,693 | 9/1936 | Lewin | 215/230 |
| 2,141,722 | 12/1938 | Morgan | 215/230 |
| 3,220,619 | 11/1965 | Lodding et al. | 222/484 |
| 3,547,746 | 7/1967 | Gwinner | 215/230 |
| 4,209,100 | 6/1980 | Uhlig | 222/480 |
| 4,444,326 | 4/1984 | Musel | 215/209 |

FOREIGN PATENT DOCUMENTS

| | | | |
|---|---|---|---|
| 2193193 | 2/1988 | United Kingdom | 222/541 |

*Primary Examiner*—H. Grant Skaggs

[57] ABSTRACT

A dispensing closure is equipped with child resistant means of securing same on a container and provides for concentric primary orifice for dispensing that is capable of enlarging its size to a secondary orifice for easy rinsing of the container package or complete product removal as desired. A pull ring is secured to the closure top wall surrounding the primary orifice and an annular line of weakening is formed in the top wall encircling the ring pull and defining an enlarged area. The ring pull may be used to manually remove the material of the enlarged area portion and provide the enlarged orifice. The removable material can provide for marketing promotions of the package. The preferred closure is illustrated as a snap hinged cover cap and child resistant dispensing closure in which the main closure includes a skirt wall and radially-spaced flexible outer wall that is deformable to open the cover cap which provides a further child resistant feature to the package.

7 Claims, 3 Drawing Sheets

DISPENSING CLOSURE WITH PULL TAB FOR ENLARGING ORIFICE

The invention relates to plastic dispensing closures for containers that provide for child resistant use, i.e. a safety closure, which prevents children from removing the closure and emptying the contents of the container. More particularly, the invention relates to dispensing closures which permit rinsing the container or rapid emptying of the product from the container without removing the closure, yet provides a functional orifice for dispensing product in normal use.

BACKGROUND OF THE INVENTION

Dispensing closures on containers provide a pouring orifice for the product of a size that is designed according to product type to dispense same in desired volume. In prior art closures of this type, in order to rinse the container or dispense product from it at a greater rate and volume may require the removal of the closure from the container. Many products are undesirable and potentially harmful in the hands of children if they are able to remove the closure and drink from the container or spill its contents. By having the closure affixed to the container in such fashion that it is not readily removable to provide a child safety package defeats the function of rinsing the container contents, flushing it or rapid pouring of its contents when so desired by the adult user.

DESCRIPTION OF RELATED PRIOR ART

In U.S. Pat. Nos. 3,495,746 and 3,750,820, a closure is provided with a prescored seal diaphragm closing the pour out orifice that has a ring pull attached to it. When the package is to be opened and used for the first time, the ring pull is lifted which tears out the diaphragm and opens a single size of pour out orifice. The U.S. Pat. No. 3,750,820 patent teaches reinserting the removed diaphragm and attached ring pull as a stopper for resealing the pour out orifice. This closure is made child resistant against easy removal from the container.

In U.S. Pat. No. Re. 29,850, there is disclosed a snap-on fitment with center diaphragm and attached ring pull device. A secondary snap cap is placed over the primary closure covering the ring pull. To open the container the first time the ring pull is lifted and diaphragm removed by tearing along a weakened line providing a single pour out orifice. The closure does not include a means for rendering it child resistant on the container and the fitment is removable.

SUMMARY OF THE INVENTION

It is the purpose of this invention to provide a dispensing closure that is attached to the container by means that prevents removal by young children and which includes a primary dispensing orifice designed for normal pour out use of the product in the package. The primary sized orifice is molded in the top wall of the closure. An annular line of weakening is also provided in the top wall encircling this pour out orifice which is of an enlarged size to define a larger secondary orifice. The material portion inside the encircled weakened line is manually rupturable and removable by a ring pull of sufficient size to insert a finger or implement. The ring pull is formed and securely attached to the top wall of the closure, such as in molding, thereby attaching the ring pull in the area between the primary orifice and the line of weakening. Pulling on the ring pull ruptures the top wall portion along the annular line of weakening removing that top wall material including the primary pour out orifice portion. The package then has an enlarged orifice area for rinsing the container or rapidly pouring its contents. The invention is preferably adapted to a hinged snap-cap style of dispensing closure.

Another object of the invention is to provide a "proof-of-purchase" portion or marketing feature to the package. The portion of the closure top wall that is removable by the ring pull may be stamped or laminated with indicia that the purchaser submits to the manufacturer under a marketing promotion. The "proof-of-purchase" portion of the closure is incorporated on the removable portion attached to the ring pull and placed such that it may only be accessible by removal of the top wall portion around the primary orifice.

For a further understanding of the invention, reference is made to the drawings and the description thereof, to the detailed description of the invention and to the appended claims.

DETAILED DESCRIPTION OF THE INVENTION

Figure 1:
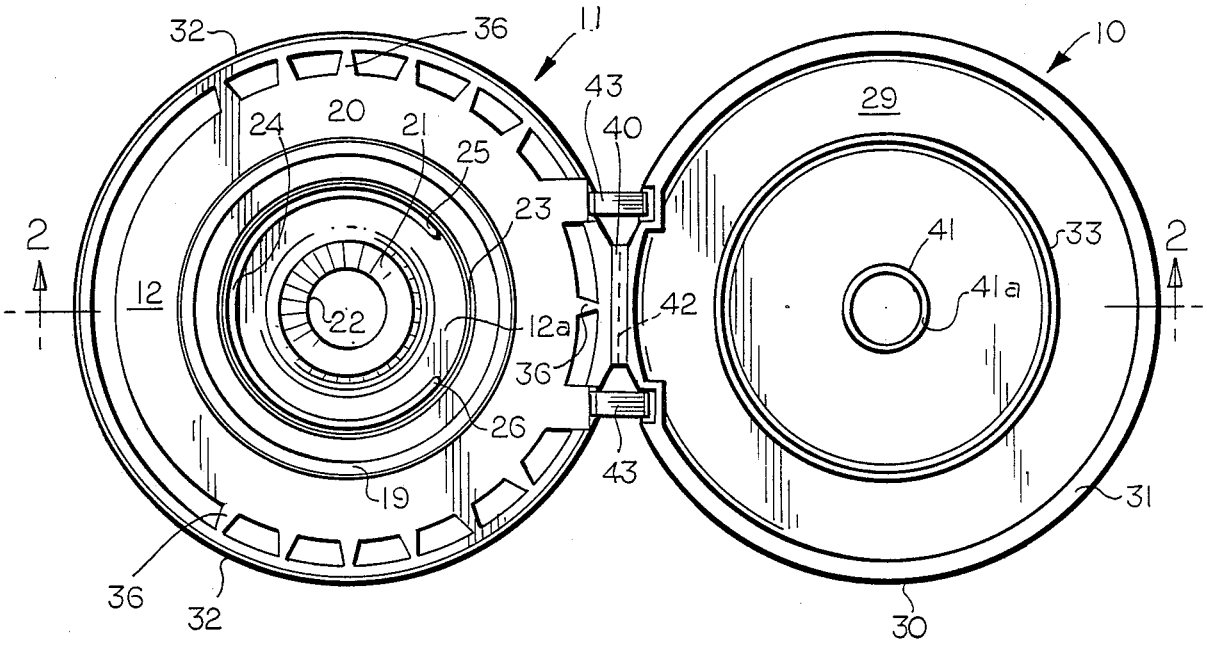
FIG. 1 is a top plan view of the dispensing closure of the invention.
Figure 2:
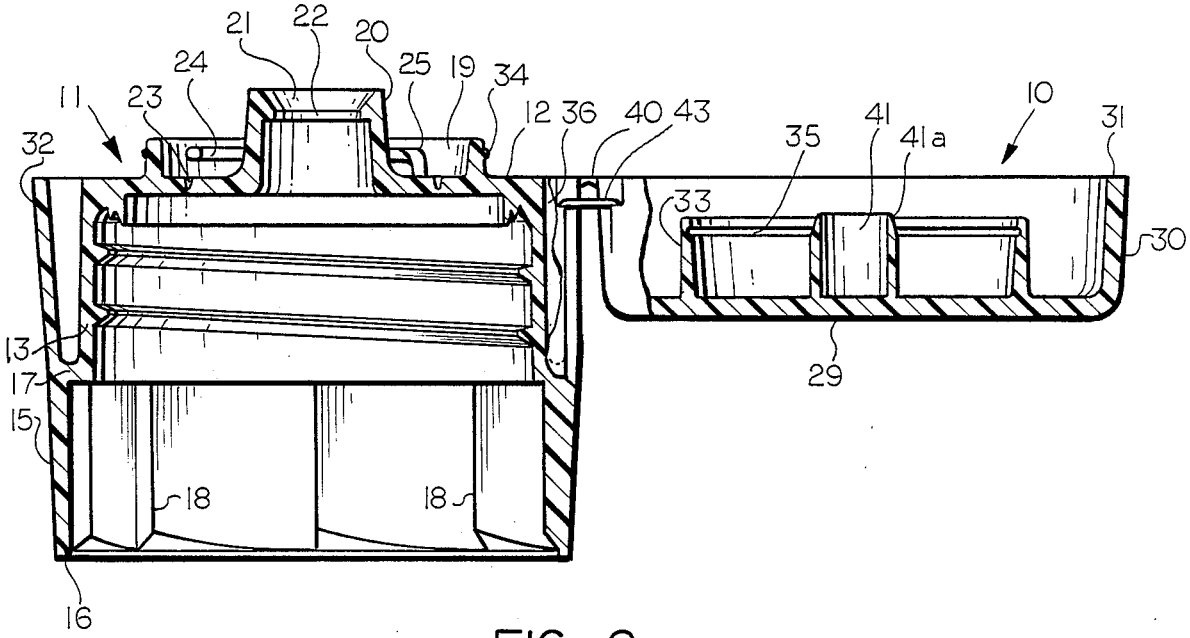
FIG. 2 is a sectional elevational view taken along line 2—2 on FIG. 1.
Figure 4:
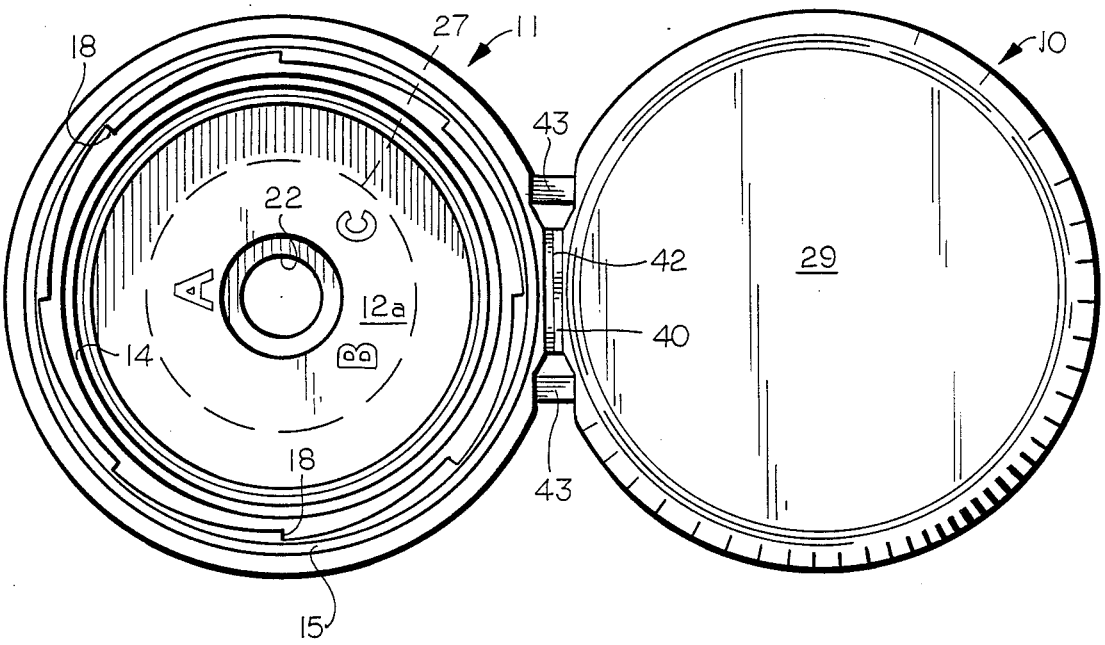
FIG. 4 is a bottom plan view of the dispensing closure shown on FIG. 1.

As is shown in FIGS. 1 and 2, a snap-hinged dispensing closure is molded in one piece from thermoplastic material such as polypropylene or polyethylene and comprises a cover cap 10 and main body 11. A main closure body 11 is comprised of a top wall 12 and downwardly depending skirt 13. Internal threads 14 are molded in the annular skirt wall 13. The lower end of skirt wall 13 below the threads has an annular wall 15 depending downwardly to the free edge 16. Annular wall 15 has an enlarged diameter and is joined at the stepped area 17 contiguous with the threaded skirt wall. The annular wall 15 includes internal ratchet projections 18 annularly spaced to provide a means for locking the main closure 11 onto a container finish after it is threaded onto container threads that correspond with threads 14.

The top wall 12 includes a larger diameter upstanding annular wall 19 which encircles a center circular pouring spout 20. The top edge of spout 20 includes a chamfered surface 21 and internal lip 22 which defines the primary pour out orifice for dispensing the product from a container equipped with the closure.

A secondary larger orifice is defined by the circular V-notch 23 molded in the top wall inwardly of the annular wall 19. This notch 23 provides a line of weakening in the top wall of the main closure that is rupturable for removing the portion it circumscribes thereby defining a secondary orifice.

Figure 3:
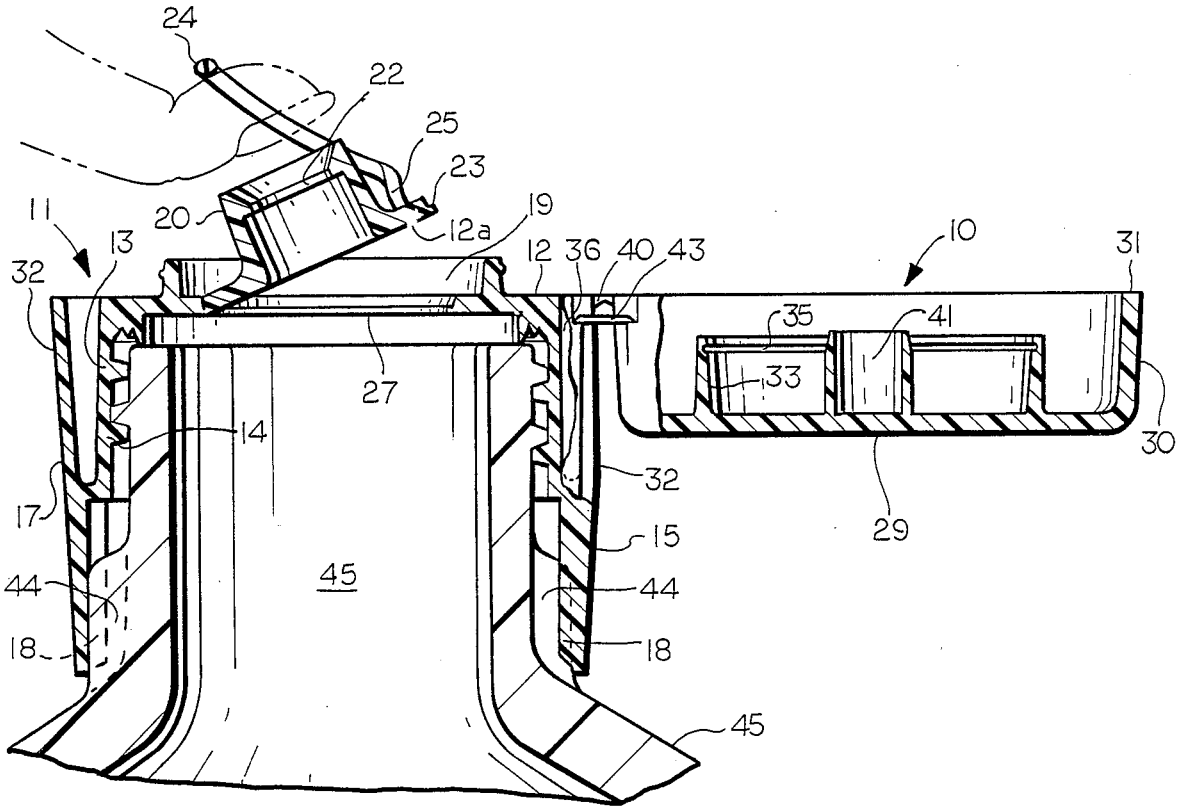
FIG. 3 is a sectional elevational view like FIG. 2 showing the removal of the top wall portion by the ring pull member.
Figure 5:
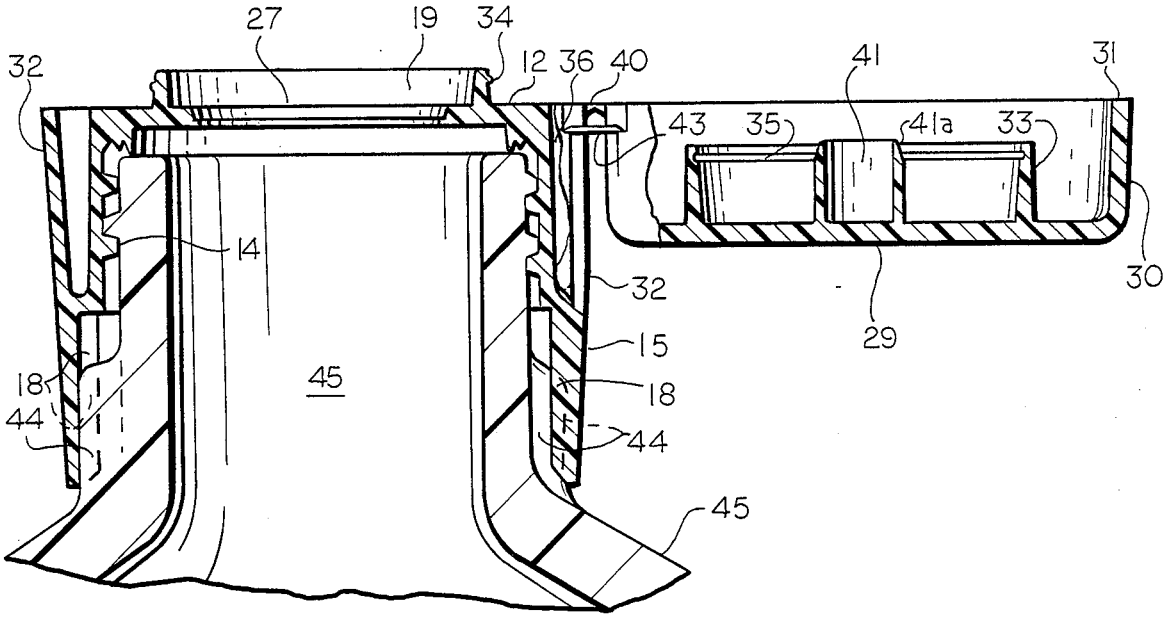
FIG. 5 is a sectional elevational view of the dispensing closure shown on FIG. 3 after the top wall portion is removed thereby providing the larger secondary pouring orifice.

A pull ring 24 is integrally attached to the top wall 12 adjacent the V-notch 23 and on the portion including spout 20. Pull ring 24 is C-shaped, the opposite ends 25 and 26 thereof being integrally attached to the top wall portion. As is shown on FIG. 3, the pull ring 24 may be grasped opposite the connection points 25 and 26, lifted vertically and pulled to one side thereby rupturing the plastic along the weakening line 23 until the portion of plastic 12*a* inside circular line 23 breaks free from the other part of top wall 12. Removal of portion 12*a* leaves a rim 27 (FIG. 5) defining the larger secondary orifice of the closure. The secondary orifice is of a size to permit rinsing or flushing of the package filled with a viscous product without removal of the closure from the container; and permits the complete removal of viscous product from the container. The primary orifice defined by lip 22 is sized for recommended use in dispensing the product when the container includes a sufficient supply of product therein.

Figure 6:
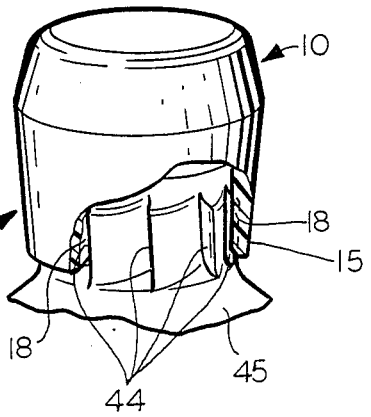
FIG. 6 is a perspective view of the package in which the closure skirt is partially broken away showing the lock means for the closure on the container neck.

In the illustrated preferred embodiment, the dispensing closure includes the cover cap 10 which is molded integrally with main body 11. Cap 10 includes a top wall 29 and peripheral skirt 30. When cover cap 10 is flipped to its closed position (FIG. 6), the free edge 31 of the skirt is adapted to fit flush with the outer flexible circular wall 32 of main body 11. The wall 32 is a smooth vertical continuation of the lower annular wall 15 attached to the skirt 13.

A circular wall 33 depends inwardly and perpendicular to the plane of top wall 29 of the cap and is adapted to enclose and encircle the annular wall 19 on the top of main closure 11. A small annular bead 34 is provided on the outer surface of wall 19 near its top end and a corresponding annular groove 35 is formed on the inside surface of wall 33. Upon closing cover cap 10, the bead 34 fits in the groove 35 in a snug fashion providing for a snap fit latch to hold the cover cap closed. The cap 10 is opened by inwardly deflecting the outer wall 32 of the base closure 11 and pushing cover cap 10 upwardly to disengage the bead 34 and groove 35.

The outer wall 32 of the main closure is spaced from skirt 13 and supported radially at its upper end by the segmented webs 36 dispersed in annular array around the periphery of skirt 13. Webs 36 are flush at the top of skirt 13 and are flush at the top of outer wall 32. The webs 36 are tapered radially outwardly to the point of their attachment with the wall 32. The annular distribution of the webs 36 are over about 270° of the periphery. A 90° arc span is centered on the diameter through the center of hinge 40 on the opposite side of the main body 11. The 90° span is absent the webs 36 which renders the wall 32 flexible and readily deformable inwardly in that area by thumb pressure. By manually deflecting wall 32 radially inwardly opposite the hinge 40 exposes a portion of the cover cap skirt edge 31 to lifting pressure, thereby enabling opening the cover cap and disengaging the bead 34, groove 35 lock means to initiate opening cover cap 10.

A second concentric circular wall 41 depends perpendicularly from the top wall 29 of the cover cap and is adapted to telescope inside the bore of spout 20 of the main body 11 when the cover cap is closed. This circular wall fits inside its rim 22 and has peripheral contact, the chamfered surface 21 guiding the wall 41 inside the circular area by correspondingly chamfered surface 41*a*. The wall 41 serves as a plug member that fits inside the spout of the main body and engages the rim 22 thereof to clean the spout orifice of material poured over the rim from the container in normal use. The fit of the plug wall 41 in the spout also assists in keeping the cover cap closed and secured.

The frontal area of the cover cap skirt is used to open the cover cap and rotate it about integrally molded hinge 40. The upper surface of hinge 40 lies in the plane of top wall 12 of the main body 11 and the free edge 31 of the skirt of the cover cap. The hinging action is about the inverted V-section of hinge 40 at apex line 42 (FIG. 1). A pair of hinge straps 43 are provided, one on either side of hinge 40, the length of hinge 40 being more than the width of each of straps 43. The straps 43 extend between the perimeter surface of skirt 30 of the cover cap and the outside wall 32 of the main closure. The straps are proportioned so they stretch in operation during both opening and closing the cover cap 10 on the main body 11 and provide a snap hinge action with the characteristics of a "live hinge" for the cover cap. This live hinge action is enhanced by the relative flexibility of wall 32 and its integral point connections to the main body by webs 36 at the top edge of wall 32.

Figure 7:
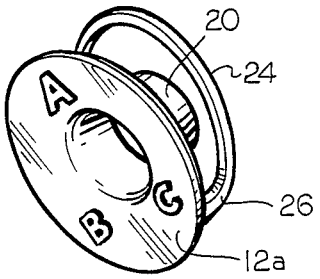
FIG. 7 is a bottom perspective view of the top wall portion and ring pull of the closure showing manufacturer's "proof-of-purchase" information on the under surface.
Figure 8:
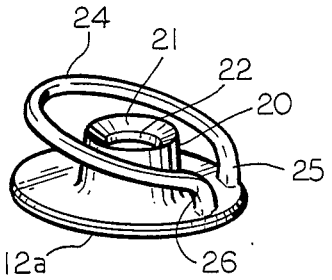
FIG. 8 is a top perspective view of the top wall portion and ring pull shown on FIG. 7.

The normal use and operation of the closure is apparent from the foregoing description in that the cover cap rotates about hinge line 42 to closed and open positions. The dispensing of product normally occurs through the primary small orifice provided by spout 20 extending through top wall 12 of the main closure body. As may be desired to enlarge the orifice, the ring pull 24 is lifted and pulled upwardly, in a fashion illustrated on FIG. 3. The annular groove pattern provided at 23 ruptures the material of top wall 12 until the rupture circumscribes spout 20 and the portion 12*a* shown on FIGS. 7 and 8 is fully separated and removed. This provides the secondary larger orifice for the package. Inasmuch as the ratchet teeth 18 of the closure are engaging ratchet teeth 44 of the container 45 preventing unscrewing the closure, the secondary orifice permits cleaning, flushing or rapid removal of product from the container without removal of the closure.

The removed portion 12*a* is shown on FIGS. 7 and 8. The closure may be manufactured or retrofitted before filling with indicia, such as shown as the "A-B-C" printing on the under-surface of portion 12*a*. The indicia may be preprinted on a gasket or seal (not shown) that is assembled with the capping of the filled container and constructed such that the closing of the plug wall 41 of the cover cap severs the membrane to open the primary orifice. The indicia is severed and removed with the enlarged portion 12*a* when it is removed to form the secondary orifice. This indicia may provide proof-of-purchase information by the manufacturer of the packaged contents for product promotions, rebates or the like.

The dispensing closure illustrated in the drawings utilizes the concepts and principles of the invention set forth in the appended claims. The hinged style of dispensing closure is a preferred example of closure, however, other forms of dispensing closures may be manufactured to utilize the invention. Those familiar with the art of manufacturing and utilizing dispensing closures in product packaging will appreciate the concepts of the invention as can be employed in a variety of closures which differ from the closure illustrated herein as to matters within the scope of ordinary engineering skill in the field.

I claim:

1. A molded plastic, child-resistant, pouring closure for a container comprising a tubular inverted cup-shaped body including a top wall and integral skirt wall, means on the skirt wall adapted for attaching the closure on the neck of the container, an annular upstanding integral spout on said top wall of said body defining the primary orifice adapted for dispensing from said container, a line of weakening in the top wall encircling said primary orifice means comprising an annular V-notch molded in said top wall defining a rupturable line encirclement of said primary orifice and adapted to define a larger secondary orifice, an integral upstanding circular wall on the top wall encircling and spaced radially outwardly from said line of weakening therein, a cover cap hinged to said tubular body near the periphery thereof for swinging movement over said body and away from said body between closed and open positions, a ring pull member integrally connected to said top wall inwardly of the line of weakening and adapted for rupturing the top wall along said encircling line of weakening tearing out said upstanding spout, thereby providing said enlarged secondary orifice opening in the top wall of said body, a circular wall on the underside of said cover cap adapted to encircle and enclose said circular wall on the top wall of said body, said circular walls including means engageable in closed position of the cover cap for holding said cover cap closed, a circular plug means on the underside of said cover cap adapted for inserting same in the primary pouring orifice for closing it when said cap is swung over said body, a flexible annularly disposed vertical wall connected to said body radially spaced from the skirt wall and substantially encircling same, said cap having a top wall and peripheral skirt, hingedly connected to said flexible wall of said body, said skirt of the cap being co-extensive with the flexible wall of said body in closed position to provide a smooth wall surface extending between said cap and said body, said flexible annular wall being radially deflectable for disengaging the means holding the cover cap closed and for opening said cap, and means on said skirt of said body engaging the container and locking the tubular body on the neck of the container against removal after said body is attached to the container rendering the closure child-resistant to its removal from the container.

2. The plastic pouring closure of claim 1 in which said means attaching said body on the container includes threads on the interior of the upper skirt portion of said body, and plural, spaced, axially extending ratchets in the interior of the lower skirt portion of said body, said ratchets adapted to engage external projections on the container neck after the closure is threaded thereon thereby locking the closure against unthreading from the container.

3. The plastic pouring closure of claim 1 which includes means applied to the primary pouring means on the top wall of said body providing proof-of-purchase indicia on the rupturable removable portion of the closure.

4. A child-resistant molded plastic dispensing closure for use with a container comprising a base closure having a skirt wall and a top wall, said skirt wall including thread means for attaching the base closure to a threaded container, an annular upstanding integral spout on said top wall defining a primary pouring orifice for dispensing from the container, a weakened annular line in said top wall defining a tear-out segment of said top wall encircling said primary pouring orifice, said segment being inclusive of the primary pouring orifice, a substantially ring-shaped pull member having an arcuate portion encircling said primary pouring orifice and connected to said tear-out segment, said weakened annular line being rupturable by a pulling force exerted on said pull member, whereby pulling said ring-shaped member removes the tear-out segment in said top wall of the base closure providing an enlarged secondary orifice, a circular upstanding wall on said top wall encircling said tear-out segment, a secondary cap hingedly secured to the base cap near the periphery thereof and pivotally movable on the base cap between closed and open positions, means on said cap for closing said primary and secondary orifices when said cap is in closed position, a flexible annularly disposed vertical wall connected to the base closure radially spaced from the skirt wall and substantially encircling same, the secondary cap being hinged to said flexible wall, said secondary cap having a top wall and peripheral skirt, the latter being co-extensive with the flexible wall of the base closure in closed position to provide a smooth vertical wall surface between the annular cover cap and base closure, a circular wall on the inner surface of the top wall of said secondary cap encircling the circular wall on the top of the base closure, said walls including means engaged in the closed position of the cover cap holding it closed, the deflection of the flexible vertical wall opposite said hinge of the cover cap, providing for disengaging said holding means for opening said cap, and means on said skirt wall below the thread means thereon for engaging projections on the container resisting removal which comprise ratchet teeth on said skirt wall adapted to engage the projections on the outer surface of the container, thereby rendering the closure child-resistant for removal from the container.

5. The molded plastic dispensing closure of claim 4 in which the tear-out segment bears indicia for product identification in marketing promotions and the like.

6. The child-resistant closure of claim 4 in which means holding the secondary cap closed comprises an annular bead on the outer surface of the circular wall on the base closure and a groove on the inside surface of the circular wall on the secondary cap, the bead and groove engaging upon telescoping the respective circular walls providing a snapfit latch to hold the secondary cap closed.

7. The molded plastic dispensing closure of claim 4 including an annular skirt wall on the secondary cap having a lower free edge circumferentially adjacent the flexible wall of the base when the secondary cap is in its closed position rendering the cover cap child resistant for opening the latter, deflection of the flexible wall portion radially inwardly exposing the cover cap free edge for opening the cover cap.

* * * * *